US006866273B2

(12) United States Patent
Barbieri et al.

(10) Patent No.: US 6,866,273 B2
(45) Date of Patent: Mar. 15, 2005

(54) SLIDING DEVICE

(75) Inventors: G. Scott Barbieri, Middlebury, VT (US); Matt Cappozzi, Stowe, VT (US)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 09/733,626

(22) Filed: Dec. 8, 2000

(65) Prior Publication Data

US 2002/0070515 A1 Jun. 13, 2002

(51) Int. Cl.[7] ..... B62B 15/00
(52) U.S. Cl. ..... 280/14.21; 280/7.14
(58) Field of Search ..... 280/14.21, 14.25, 280/607, 617, 14.26, 14.22, 7.12, 7.13, 7.14, 600

(56) References Cited

U.S. PATENT DOCUMENTS

| | | | |
|---|---|---|---|
| 27,015 | A | 1/1860 | Wicks et al. |
| 31,043 | A | 1/1861 | Wicks et al. |
| 31,797 | A | 3/1861 | Gibson et al. |
| 59,796 | A | 11/1866 | Elmer et al. |
| 65,396 | A | 6/1867 | Ladd et al. |
| 310,923 | A | 1/1885 | Wardwell et al. |
| 657,822 | A | 9/1900 | Handwerk |
| 1,051,614 | A | 1/1913 | Minish |
| 1,066,445 | A | 7/1913 | Beardsley et al. |
| 1,350,929 | A | 8/1920 | McCarthy |
| 1,428,676 | A | 9/1922 | Barlow |
| 1,551,620 | A | 9/1925 | Ricke |
| 1,569,885 | A | 1/1926 | Robblee |
| 1,601,105 | A | 9/1926 | Cameron |
| 2,181,391 | A | 11/1939 | Burgeson et al. |
| 2,187,437 | A | 1/1940 | Wanat |
| 2,188,080 | A | 1/1940 | Grimm |
| 2,206,035 | A | 7/1940 | Hammond |

(List continued on next page.)

FOREIGN PATENT DOCUMENTS

| | | |
|---|---|---|
| CA | 762342 | 7/1967 |
| CA | 946864 | 5/1974 |
| CA | 1282441 | 4/1991 |
| DE | 1075477 | 2/1960 |
| DE | 79 00 648 | 5/1979 |
| FR | 929149 | 12/1947 |
| FR | 2405722 | 5/1979 |
| FR | 2420984 | 10/1979 |
| FR | 2423243 | 11/1979 |
| FR | 2 428 452 | 1/1980 |
| FR | 2428452 | 1/1980 |
| JP | 55-35607 | 3/1980 |
| JP | 10-258148 | 9/1998 |

OTHER PUBLICATIONS

Selected pages from Sno–Sk8sno–sk8.com, printed from www.snow–sk8.com on Oct. 20, 2000.

Sno–Sk8 sno–sk8.com, printed from www.sno–sk8.com on Oct. 20, 2000.

Bideck News, 2 pages printed from www.bideck.com on Nov. 27, 2001.

Bideck News, 1 page printed from www.bideck.com on Dec. 14, 2001.

*Primary Examiner*—Avraham Lerner
(74) *Attorney, Agent, or Firm*—Wolf, Greenfield & Sacks, P.C.

(57) ABSTRACT

A sliding device provides a binding-free apparatus suitable for trick and other riding on snow, sand, ice and other surfaces. An elongated deck to support the rider is elevated from and attached to an elongated runner, which provides a surface that slides on the snow, sand, etc. The runner may be made more narrow than the deck to provide leverage for the rider to tilt the device onto an edge of the runner to steer the device. The device may not have any defined front or back portion and thus be adapted for riding in either direction.

95 Claims, 3 Drawing Sheets

U.S. PATENT DOCUMENTS 2,258,046 A 10/1941 Clement
2,354,627 A 7/1944 Wheeler
2,357,928 A 9/1944 Bowen et al.
2,414,244 A 1/1947 Roth
2,492,965 A 1/1950 Carr
2,526,100 A 10/1950 Weirick
2,547,209 A 4/1951 Holbrook
2,568,070 A 9/1951 Holbrook et al.
2,661,219 A 12/1953 Coulson, Jr.
2,666,652 A 1/1954 Lammers et al.
2,750,198 A 6/1956 Moore et al.
3,030,123 A 4/1962 Dworak
3,145,029 A 8/1964 Ollanketo
3,147,020 A 9/1964 Dahl
3,260,531 A 7/1966 Heuvel
3,260,532 A 7/1966 Heuvel
3,276,785 A 10/1966 Tonelli
3,332,697 A 7/1967 Hagen
3,343,847 A 9/1967 Christy
3,370,862 A 2/1968 Huffnagle
3,378,275 A 4/1968 Rockwood et al.
3,414,284 A 12/1968 Rosekrans, Jr. et al.
3,436,088 A 4/1969 Kunselman
3,578,351 A 5/1971 McAtee
3,580,592 A 5/1971 Schrecenogost
3,580,605 A 5/1971 Spitler
3,583,722 A 6/1971 Jacobson
3,628,804 A 12/1971 Carreiro
3,704,024 A 11/1972 Martin
3,717,359 A 2/1973 Peronnon et al.
3,724,867 A 4/1973 Hawthorne
3,734,523 A 5/1973 Field
3,751,062 A 8/1973 White
3,776,565 A 12/1973 Granville
3,782,744 A 1/1974 Milovich
3,782,745 A 1/1974 Stoveken
3,795,409 A 3/1974 Cudmore
3,797,844 A 3/1974 Smolka et al.
3,801,767 A 4/1974 Marks
3,802,714 A 4/1974 Freegard
3,862,766 A 1/1975 Bogdanovich
3,870,330 A 3/1975 Hatano et al.
3,877,709 A 4/1975 Fritz
3,899,184 A 8/1975 Haddad
3,899,185 A 8/1975 Martin
3,900,204 A 8/1975 Weber
3,900,208 A 8/1975 Hjelmquist
3,913,930 A 10/1975 Okonski
3,917,297 A 11/1975 Fruh
3,918,730 A 11/1975 Schultes
3,941,397 A 3/1976 Kidder et al.
3,945,655 A 3/1976 Banks et al.
3,980,322 A 9/1976 Schultes
3,982,597 A 9/1976 Callaway
D243,263 S 2/1977 Koblick
4,018,455 A 4/1977 Bieler
4,039,204 A 8/1977 Frey
4,043,565 A 8/1977 Mogannam
4,066,276 A 1/1978 Salomon
4,068,861 A 1/1978 Zemke, Jr.
4,093,267 A 6/1978 Horn
4,101,142 A 7/1978 Turner
4,109,931 A 8/1978 Woitschatzke et al.
4,114,913 A 9/1978 Newell et al.
4,116,455 A 9/1978 Dotson et al.
4,138,128 A 2/1979 Criss
4,138,138 A 2/1979 Grossmann
4,139,214 A 2/1979 Meyer
4,140,331 A 2/1979 Salomon
4,141,566 A 2/1979 Benes et al.
4,141,570 A 2/1979 Sudmeier
4,152,007 A 5/1979 Smith
4,160,552 A 7/1979 Kupka
4,161,323 A 7/1979 Wetteland
4,161,324 A 7/1979 Colvin
4,163,565 A 8/1979 Weber
4,165,091 A 8/1979 Chadwick
4,171,827 A 10/1979 Gley
4,175,759 A 11/1979 Strunk
4,194,753 A 3/1980 Schrishuhn, Jr.
4,219,214 A 8/1980 Kostov
4,221,394 A 9/1980 Campbell
4,225,145 A 9/1980 Carr
4,227,708 A 10/1980 Cote
4,230,330 A 10/1980 Muhammad
4,234,207 A 11/1980 De Vigili
4,244,593 A 1/1981 Malone
4,288,092 A 9/1981 Mukri
4,305,603 A 12/1981 Muller et al.
4,312,518 A 1/1982 Svoboda
4,323,258 A 4/1982 Culpeper
4,342,468 A 8/1982 Beyl
4,376,545 A 3/1983 Sandorf
4,398,734 A 8/1983 Barnard
4,403,785 A 9/1983 Hottel
4,433,855 A 2/1984 Wyke
4,466,626 A 8/1984 Leritz
4,521,029 A 6/1985 Mayes
4,596,400 A 6/1986 Stenius
4,606,548 A 8/1986 Little
4,674,765 A * 6/1987 Powell ..... 280/607
4,690,423 A 9/1987 DeVigili
RE32,567 E 12/1987 Emert et al.
4,725,069 A 2/1988 Stampacchia et al.
4,773,659 A 9/1988 Rygiel
4,784,233 A 11/1988 Favors
4,795,183 A 1/1989 Reuters
4,804,200 A 2/1989 Kuchler
4,848,781 A 7/1989 Dykema et al.
4,896,893 A 1/1990 Shumays et al.
4,911,461 A 3/1990 Humphrey
4,986,561 A 1/1991 Humphrey
D317,036 S 5/1991 Crivello
5,018,760 A 5/1991 Remondet
5,057,045 A 10/1991 Myers
5,069,473 A 12/1991 Erdei
5,125,687 A 6/1992 Hwang
5,145,202 A 9/1992 Miller
5,156,644 A 10/1992 Koehler et al.
D333,172 S 2/1993 Body
5,249,816 A 10/1993 Southworth
5,280,943 A 1/1994 Commier et al.
5,285,742 A 2/1994 Anderson
5,344,167 A 9/1994 Strouth
5,356,168 A 10/1994 Ozburn
5,393,086 A 2/1995 Le Masson et al.
5,397,150 A 3/1995 Commier et al.
5,397,154 A 3/1995 Baldwin
5,398,957 A 3/1995 Leighton et al.
5,413,371 A * 5/1995 Trimble ..... 280/602
5,447,322 A 9/1995 Masson et al.
5,458,351 A 10/1995 Yu
5,509,683 A 4/1996 Daniel
5,516,126 A 5/1996 Myers
5,547,204 A 8/1996 Gamzo
D375,772 S 11/1996 Riggs et al.
5,580,077 A 12/1996 Dodge
5,613,695 A 3/1997 Yu
5,649,722 A 7/1997 Champlin
5,765,854 A * 6/1998 Moore et al. ..... 280/618
5,820,154 A 10/1998 Howe 5,868,405 A 2/1999 Lavecchia et al.
5,957,478 A 9/1999 Vigny
5,970,631 A 10/1999 Inman
6,006,451 A 12/1999 Morris et al.
6,041,525 A 3/2000 Kelley
6,113,113 A 9/2000 Longoni et al.
6,113,116 A 9/2000 Stanton
6,113,508 A 9/2000 Locarno et al.
6,115,946 A 9/2000 Morris et al.
6,131,939 A 10/2000 Fels
6,139,031 A 10/2000 Wingard
D448,441 S 9/2001 Wolf
6,311,990 B1 * 11/2001 Landry ..... 280/14.23
2002/0008360 A1 1/2002 Ellington
2003/0160404 A1 * 8/2003 Bobrowicz ..... 280/14.21

* cited by examiner

SLIDING DEVICE

FIELD OF THE INVENTION

This invention relates to sliding devices for use on snow, ice, sand or other surfaces.

BACKGROUND OF THE INVENTION

There has been a desire amongst snowsports enthusiasts to perform tricks similar to those performed with a typical skateboard. For example, snowboards have been used to perform skateboard-type tricks, such as half pipe and quarter pipe maneuvers and the like. Bindings fixed in place on the snowboard secure the rider's feet so that the rider can maneuver the board, e.g., tilt the board on edge to execute a turn. However, the bindings prevent the rider from freely moving his or her feet on the board, which in turn prevents the rider from performing some tricks, such as those common among skateboard riders.

SUMMARY OF THE INVENTION

In an illustrative embodiment, a sliding device in accordance with the invention provides a rider with the ability to perform skateboard-like tricks on snow, sand, ice, metal, plastic or other sliding surfaces. For example, the sliding device in one illustrative embodiment may have a runner having first and second upturned ends and a middle portion between the upturned ends. A deck, having an upper surface for supporting a rider, may be elevated from and attached to the runner by a spacer. The spacer is secured to the runner at a runner attachment position and secured to the deck at a deck attachment position so that forces applied by a rider on the deck are transmitted to the runner, and so that a portion of the deck near the deck attachment position is not free to pivot about a longitudinal axis relative to a portion of the runner at the runner attachment position. The runner and the deck are constructed and arranged to allow riding with both the first upturned end of the runner forward and the second upturned end of the runner forward.

In another illustrative embodiment, the deck, runner and/or a spacer may be arranged so that at least a portion of either the deck or the runner can move longitudinally relative to the other. Thus, a rigid attachment between the deck and runner may be maintained to prevent relative pivoting of the deck and runner (at least about a longitudinal axis), while allowing longitudinal movement, e.g., sliding, of one relative to the other. This feature may allow adjustment of one or more spacers used to interconnect the deck and runner, provide for shock dampening in the spacer or other element, or provide the runner with greater flexibility since it is not necessarily prevented from longitudinal sliding by the deck.

In another illustrative embodiment, the sliding device has a runner having at least one upturned end, a middle portion and a lower surface, and a deck elevated from the runner and having an upper surface that supports a rider. A spacer is secured to the runner at a runner attachment position and secured to the deck at a deck attachment position so that forces applied by a rider on the deck are transmitted to the runner. In one illustrative embodiment, a minimum spacing between the upper surface of the deck and a lower surface of the runner is approximately 1 to 8.375 inches, or more preferably approximately 1.75 to 4 inches. In another illustrative embodiment, a ratio of the width of the runner to the width of the deck is approximately 0.4 to 0.8, or more preferably approximately 0.45 to 0.6. In another illustrative embodiment, an angle between a plane parallel to the lower surface of the runner and a line extending between a lower edge of the runner and a lateral edge of the deck is approximately 30 and 70 degrees. In another illustrative embodiment, first and second spacers secure the runner and the deck together, and the first spacer is positioned at approximately one-fifth to one-half the length of the runner from a first end of the runner and the second spacer is positioned at approximately one-fifth to one-half the length of the runner from a second end of the runner.

Other aspects of the invention will be apparent from the detailed description below and the claims.

BRIEF DESCRIPTION OF THE DRAWINGS

Illustrative embodiments of the invention are described with reference to the following drawings, in which like reference numerals reference like elements, and wherein.

DETAILED DESCRIPTION

Figure 1:
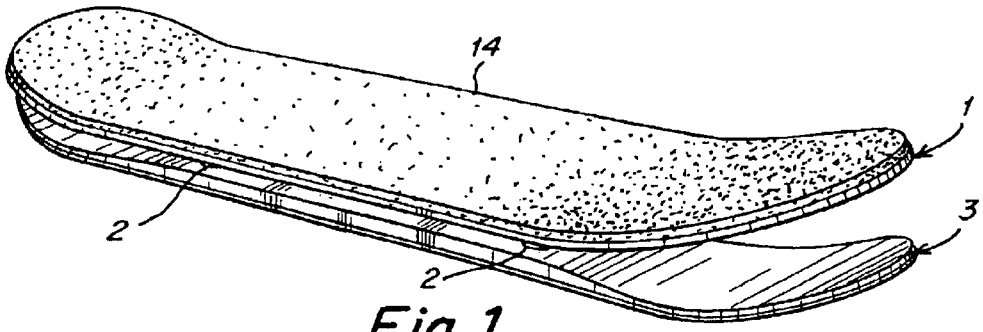
FIG. 1 is a perspective view of an illustrative embodiment of the invention.

Illustrative embodiments of the invention provide a sliding device that may be ridden by standing on the deck in much the same way as a typical skateboard. Although for clarity and ease of reference a sliding device in accordance with the invention is described in connection with a "snowdeck" for use on snow, the sliding device may be used on other surfaces, such as ice, sand, plastic, metal, and so on.

In one embodiment, the snowdeck has a bi-level design such that the rider stands in an upright position on a deck that is vertically spaced from, and attached to, a sliding portion, or runner, that contacts the sliding surface. Thus, for example, the snowdeck may be turned on the sliding surface, such as a snow-covered slope, by tilting the deck with the feet, somewhat similar to that in skateboarding. The deck can be tilted and the snowdeck steered by the rider shifting weight between her toes and heels on the deck. By tilting the snowdeck to one side or the other, the rider can cause the deck and attached runner to pivot about an edge and execute a turn like that in skiing and snowboarding. However, because the deck is vertically spaced from the runner, the rider can tilt the snowdeck without requiring bindings that secure the rider's feet to the deck. In one embodiment, the snowdeck is arranged to allow riding in either direction. That is, the snowdeck may not necessarily have a defined front or back end, but instead may provide the same or similar riding characteristics when ridden in either direction. This feature may be especially useful in trick riding.

In one illustrative embodiment of the invention, the deck is wider than the runner, thereby providing additional leverage for the rider's feet to tilt the snowdeck. For example, the runner may be made approximately 0.4 to 0.8 times the width of the deck, or more preferably approximately 0.45 to 0.6 times the width of the deck, and the runner may be attached to the deck so that it is laterally centered under the deck. The lower surface of the runner may also be vertically spaced a minimum distance of approximately 1 to 8.375 inches from an upper surface of the deck. Thus, approximately 3/10 to 1/10 of the width of the deck may laterally overhang each edge of the runner. The laterally overhanging portions of the deck provide a surface for the rider's toes or heels to apply force to tilt the snowdeck. Since the tilting force may be applied at these overhanging areas, the rider is provided with additional leverage to tilt the snowdeck than would be provided if the deck were made the same width, or smaller width, than the underlying runner.

In another illustrative embodiment, the upper surface of the deck may have uplifted portions at or near the lateral edges so that the deck presents a concave area on which the rider can stand. For example, the lateral edges of the deck may be stepped, curved or otherwise uplifted compared to the center portion of the deck to form a shallow bowl-like shape. This concavity of the deck may provide better leverage for the rider in tilting the snowdeck, since the rider can more easily and directly transfer weight to the edges using the heels and toes, or help to keep the rider's feet on the deck 1. Alternately, or in addition to the concave upper surface, the deck may have a convex undersurface so that the side edges of the deck are uplifted away from the sliding surface. This arrangement may allow for more aggressive turning at steeper tilt angles of the snowdeck, since the uplifted side edges of the deck allow greater tilting before the edges contact the sliding surface and prevent further tilting of the snowdeck. In another aspect of the invention, the upper surface of the deck may be arranged to facilitate gripping by the rider's boots or other footwear. In one illustrative embodiment, some or all of the upper surface of the deck includes a soft cover material, such as a closed cell foam. The foam may cover the entire deck surface, and has been found to provide a good gripping surface for a rider's feet. That is, it has been found that a rider's feet are more likely to stay in place on the deck when the deck is covered with a soft foam or other gripping-type material or structures (treads, rubber, etc.).

In another aspect of the invention, the placement of spacers or other elements that separate the runner from the deck may be important to the performance of the snowdeck. For example, the spacers may be arranged so that the runner and/or the deck has a desired flexibility or range of movement at the ends or in a mid-region between the spacers. In one embodiment, the spacers are placed inward from either end of the snowdeck a distance of approximately 1/5 to 1/2 of the entire length of the snowdeck. For example, although the length of the snowdeck (i.e., the length of either the deck or runner) may vary between approximately 25 and 72 inches, if the snowdeck has an approximate overall length of 32 inches, spacers may be located at approximately 6.4 to 16 inches from either end of the snowdeck. In another embodiment, the spacers are placed longitudinally apart up to approximately one-half of the total length of the snowdeck. Proper positioning of the spacers may be important, as in some embodiments it is preferable to allow the runner to flex in its mid-region to allow better turning capability and/or provide a smoother ride over rough surfaces. In some embodiments it is also important to allow the ends of the runner to flex relatively freely of the deck. This flexibility of the ends also provides improved turning ability and a smooth ride.

In one aspect of the invention, the spacers may interconnect the deck and the runner so that a portion of the deck near an attachment point with a spacer cannot pivot around a longitudinal axis of the snowdeck relative to a runner portion near an attachment point with the same spacer. Thus, for example, when a rider exerts a tilting force on one of the lateral edges of the deck, the deck may not pivot around a longitudinal axis of the deck to any great extent compared to the runner. Such a rigid attachment between the deck and the runner can provide for a more responsive snowdeck, since movements of the rider's feet are more directly transferred to the runner than if a more flexible connection is made between the deck and runner. In one embodiment, the runner may be secured to a spacer so that relative pivoting of the runner and deck around a longitudinal axis is prevented, but the runner is allowed to slide longitudinally relative to the deck, and/or allowed to move toward the deck (i.e., so that the distance between the deck and the runner is decreased). Such an attachment still provides the responsiveness of a rigid attachment while allowing greater flexing of the runner, e.g., in the runner mid-section between spacers, or providing a shock absorbing function.

In one illustrative embodiment, the deck and/or runner may be arranged so that ends of the runner can flex under normal riding conditions without contacting the deck. For example, in one embodiment, at least one end of the runner may extend beyond a corresponding end of the deck so that the runner end can flex further upwards toward the deck without contacting the deck. In an embodiment that can be ridden in both directions, i.e., a snowdeck that has upturned portions at both ends of the runner, the deck may be made shorter than the runner so that upturned portions of the runner extend past respective ends of the deck. As a result, the runner ends may be able to flex a greater distance toward the deck without touching the deck than would otherwise be possible if the deck ends extended past the runner ends. Avoiding contact between the runner ends and the deck may provide a smoother and more stable ride since contact between the flexing runner ends and the deck may result in a direct transfer of shock between the runner end and the deck, upsetting the rider's feet on the deck. In contrast, the freely flexing ends or mid-portion of the runner can absorb shocks and smooth the force transfer between the runner and the deck. Alternately, or in combination with having runner ends that extend past the ends of the deck, the ends of the deck may be upturned away from the runner ends. By upturning the ends of the deck, the runner ends may have a greater range of bending movement, thereby avoiding contact between the runner ends and the deck during normal riding conditions. However, in some embodiments, although the runner ends and deck are arranged so that the runner ends do not contact the deck during normal riding conditions, the snowdeck may be arranged so that at least one of the runner ends may contact the deck when one end of the deck is heavily weighted, e.g., when a rider stands on one end of the deck with most or all of the rider's weight. Contact between the runner end and the deck in such a condition may make certain maneuvers, such as one commonly known as an "ollie", possible or more easily performed.

FIGS. 1–5 show an illustrative embodiment that incorporates many aspects of the invention. As can be seen in FIG. 1, this illustrative embodiment includes a deck 1 that is attached to a lower sliding portion, or runner 3, by spacers 2. The deck 1 may be covered, at least partially, by a foam 14 or other grip enhancing material. The foam 14 may be a relatively soft closed cell foam or other material that helps keep a rider's feet in place on the deck 1. The foam 14 may also include other features, such as a sticky adhesive, to help keep the rider's feet on the deck 1. Although in this illustrative embodiment the snowdeck does not include bindings or any other suitable device to physically attach one or more of the rider's feet to the deck 1, bindings, straps or other devices may be used to securely fasten the rider's feet. The snowdeck may also include a leash, tether, rigid handle (similar to that on a scooter) (not shown) attached to the deck 1 or other portion of the snowdeck. The rider may hold the leash, handle or other device to help maintain balance on the snowdeck or to pull the snowdeck while walking. Alternately, the deck 1 may not include any additional features to help keep a rider's feet on the deck 1, i.e., no foam 14, bindings, handle, leash, skid-resistant material, sticky adhesive, etc.

Figure 2:
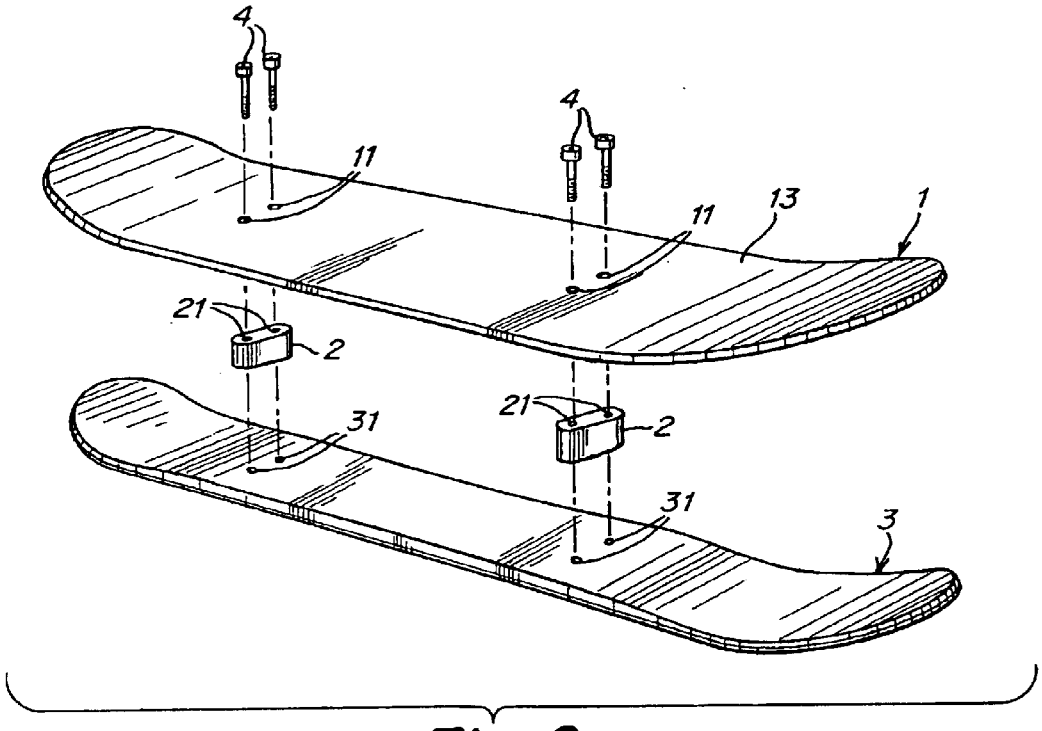
FIG. 2 is an exploded view of the FIG. 1 embodiment.

Although the deck 1 and the runner 3 may be secured to each other in any suitable way, the exploded view of the illustrative embodiment in FIG. 2 shows the rigid attachment between the deck 1 and the runner 3 in accordance with one aspect of the invention. The deck 1 is secured to the runner 3 by bolts 4 that extend through holes 11 in the deck 1 and holes 21 in the spacers 2 to engage with the runner 3 at holes 31. Threads on the bolts 4 may engage with a threaded insert, nut or other feature (not shown) at the holes 31 and be tightened to securely hold the spacers 2 between the deck 1 and the runner 3. The bolt 4 and spacer 2 arrangement may be formed to accommodate different decks 1 so that a rider may remove one deck 1 from the snowdeck to replace it with another. Further, the deck 1 and runner 3 may be attached using tool-free devices to allow quick adjustment of the attachment between the deck 1 and runner 3.

In this illustrative embodiment, the snowdeck includes two spacers 2 that have an approximately rectangular cross-sectional shape and are rigid throughout. The spacers 2 are located near opposite ends of the runner 3 and secure the deck 1 and runner 3 together so that a portion of the deck 1 near an attachment point with a spacer, e.g., a portion near a hole 11, cannot pivot around a longitudinal axis relative to a portion of the runner 3 attached to the same spacer 2, e.g., a runner portion near a hole 31. That is, although the ends and mid-section of the deck 1 and/or runner 3 may flex or pivot relative to the other, portions of the deck 1 are attached so that at least the portions near attachment points with the spacers 2 may not freely pivot relative to portions on the runner 3 near an attachment point with the same spacer 2. This rigid attachment between the deck 1 and runner 3 may provide a responsive snowdeck since force on the deck 1 can be more directly transferred to the runner 3.

It should be understood that the arrangement for attaching the deck 1 to the runner 3 is not limited to the standoffs shown in this illustrative embodiment. For example, the spacers 2 may be made of any suitable material or combination of materials, such as plastic, wood, metal and so on, and may have any suitable shape, such as square, rectangular, oval, and so on. The spacers 2 may have a height so that the deck 1 is approximately evenly spaced from the runner 3 along the length of the runner 3 between the spacers 2, or may have one end higher than the other.

Figure 7:
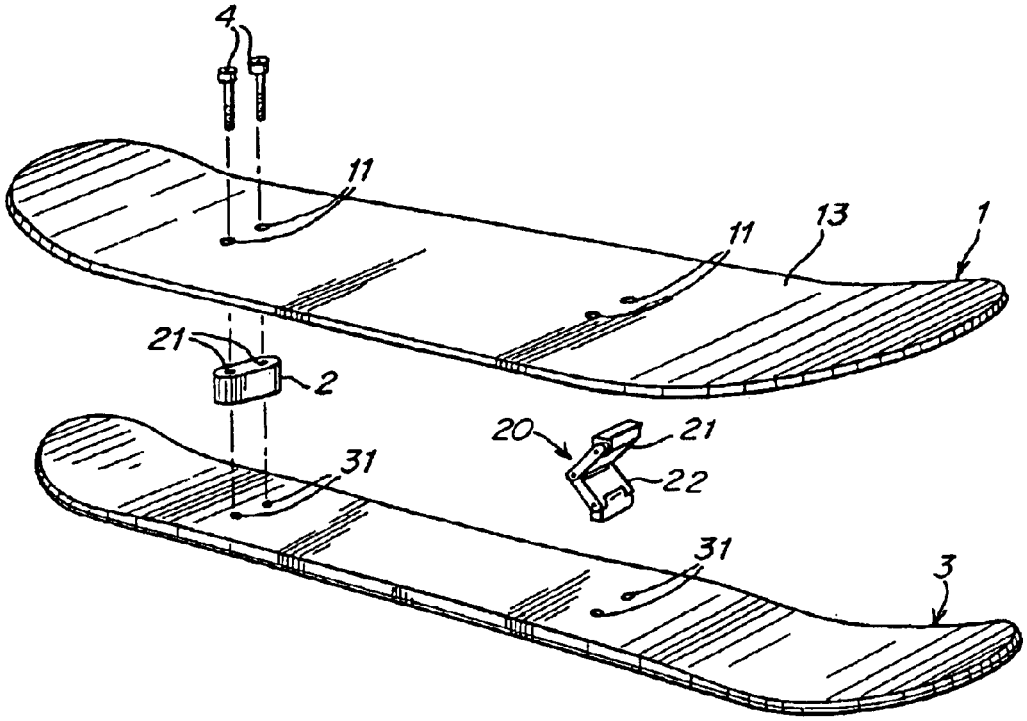
FIG. 7 is a perspective view of another illustrative embodiment of the invention.

In one aspect of the invention, the spacers 2 may provide a type of suspension between the deck 1 and the runner 3. The suspension may be spring-biased and/or dampened to provide a smooth ride on rough surfaces. For example, one or more spacers 2 may include an elastomer material, such as a rubberized washer positioned between the spacers 2 and the deck 1 or runner 3. The washer or other element may serve to absorb vibration that might otherwise be transmitted from the runner 3 through the spacers 2 to the deck 1. Alternately, a shock dampening material may be incorporated into the structure of the spacers 2. In one embodiment, one or more of the spacers 2 may be arranged to allow the deck 1 and the runner 3 to move toward each other, decreasing the distance between the deck 1 and the runner 3. For example, as shown in FIG. 7, a spacer 2 may include a spring-biased hinge 20 having an axis of rotation perpendicular to the length of the snowdeck such that one portion 21 of the hinge 20 attached to the deck 1 may rotate relative to another portion 22 of the hinge 20 attached to the runner 3. Relative rotation of the hinge portions may allow the deck 1 and the runner 3 to move toward and away from each other, and/or allow the deck 1 or runner 3 to move longitudinally relative to the other. Bias on the hinge, e.g., to move the deck 1 and runner 3 away from each other to a starting separation distance, may be provided by a metallic coil or leaf spring, elastomer material or other suitable material or device. Of course, it should be understood that the hinge is only one illustrative example. Other arrangements for allowing movement of the deck 1 and runner 3 toward each other, relative rotation of the deck 1 or runner 3 about an axis perpendicular to the length of the snowdeck, and/or longitudinal movement of the deck 1 or runner 3 relative to each other will occur to those of skill in the art. For example, the spacers 2 may be made of a resilient material that allows such movement or rotation, while preventing relative pivoting of the deck 1 and the runner 3 around a longitudinal axis. Thus, the suspension function described above is provided by the spacers 2 while still maintaining a rigid attachment between the deck 1 and runner 3 so that portions of the two may not pivot relative to each other about a longitudinal axis.

As further alternate arrangements, the two spacers 2 may be replaced with a single spacer 2, e.g., the single spacer may provide a suitably rigid attachment between the deck 1 and runner 3 while allowing desired flexibility of portions of the runner 3 at the ends and/or at a mid-region of the runner 3. Alternately, each spacer 2 may be divided into two spacers 2 so that pairs of spacers 2 are used at or near each end of the runner 3, e.g., one spacer 2 for each bolt 4. Further, the spacers 2 may be molded as part of the deck 1 and/or the runner 3, (e.g., the snowdeck, or a portion of the snowdeck, may be molded or otherwise formed as a single unitary structure), the deck 1, spacers 2 and runner 3 may be attached by an adhesive, welding, screws, rivets or any other suitable means, and so on. In short, any structure may be used to secure the deck 1 and the runner 3 together in a vertically displaced way and so that the relative rotational stiffness or rigidity of the connection between the deck 1 and the runner 3 is maintained.

Figure 3:
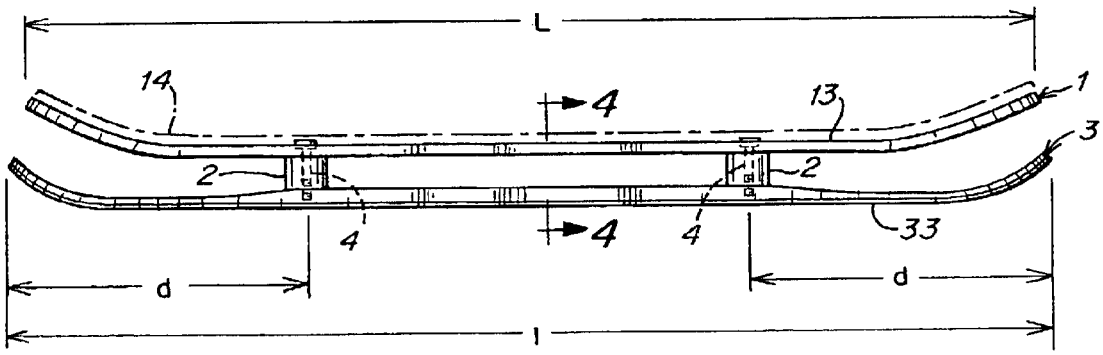
FIG. 3 is a side view of the FIG. 1 embodiment.

The side view of the illustrative embodiment in FIG. 3 shows the upturned portions at both ends of the runner 3. Having upturned portions at both ends of the runner 3 allows the snowdeck to be ridden in both directions. Thus, the snowdeck may not necessarily have any defined front or back, but instead may be symmetrical so that both ends of the snowdeck are arranged in a substantially similar way. However, in alternate embodiments that incorporate other aspects of the invention, this bi-directional arrangement of the illustrative embodiment is not required as the snowdeck may have defined front and back portions. For example, a front portion of the runner 3 may have a somewhat more upturned portion than a back portion of the runner 3, which may have no upturned portion whatsoever. Front and back portions of the snowdeck may be defined by other features, such as the way bindings, kick blocks or other features secured to the deck 1, e.g., at upturned portions of the deck 1, or other.

FIG. 3 shows that the spacers 2 are positioned at a distance d from a respective end of the runner 3. The spacers 2 may be placed at a distance d that is approximately ⅕ to ½ of the entire length l of the runner 3 to provide suitable riding characteristics. (When the spacers 2 are placed at a distance approximately ½ the entire length l of the runner 3, i.e., the center of the runner 3, a single spacer 2 may be used to attach the deck 1 and the runner 3 together.) Placing the spacers 2 a minimum distance of approximately ⅕ of the length l of the runner 3 can be useful for providing a rider with sufficient leverage and flexibility of the runner ends to lift and turn a front or back end of the snowdeck during riding. For example, the rider may place weight on one end of the deck 1 to flex the underlying runner end and lever the opposite end of the runner 3 upward. The inventors have found that, in one embodiment, positioning the spacers 2 at a distance d that is approximately one quarter of the entire length l of the runner 3 (or positioning the spacers 2 apart at a distance approximately equal to one-half of the entire length l of the runner 3) provides the desired flex of the runner 3 at both a central portion of the runner 3 between the spacers 2 and at the ends of the runner 3 as well as proper leverage for turning. As discussed above, proper flex of the middle and ends of the runner 3 may be desired in certain embodiments to allow a smooth and stable ride and/or provide better turning capability. For example, a runner 3 having a freely flexing central portion and ends may absorb the shock of bumps and other rough surfaces, as well as allow the runner to curve when executing a relatively tight radius turn. Although in this illustrative embodiment the spacers 2 are preferably placed at a distance d from the ends of the runner 3 that is one-quarter of the length l of the runner 3, other fractions of the length l of the runner 3 may be used as discussed above and may depend on the stiffness or other properties of the runner 3 or the deck 1. In addition, although in this embodiment the spacers 2 are positioned at approximately a same distance d from the ends of the runner 3, the spacers 2 may be positioned at different distances. In short, any suitable placement of the spacers 2 that provides desired flexibility of the runner 3 ends and central portion may be used.

FIG. 3 also illustrates another aspect of the invention, namely that the snowdeck is arranged so that the ends of the runner tend to not contact the deck when flexing during normal riding conditions. For example, in this embodiment, at least one of the ends of the runner 3 extends past the corresponding end of the deck 1. In this illustrative embodiment, since both ends of the runner 3 extend past a corresponding end of the deck 1, the overall length l of the runner 3 is greater than the overall length L of the deck 1. This feature of an end of the runner 3 extending past a corresponding end of the deck 1 gives the runner end a greater range through which it can bend without contacting the deck 1. For example, if the ends of the deck 1 extended past the ends of the runner 3, the tip of the upturned portions of the runner 3 would be positioned closer to the deck 1, thus limiting the range of flex of the runner end. Such an arrangement may make for a rough riding snowdeck, since the runner ends may be found to more frequently contact the deck 1 during riding. This may be countered by increasing the height h (see FIG. 4) of the spacers 2, but increasing the vertical separation between the lower surface 33 of the runner 3 and the upper surface 13 of the deck 1 may also make the snowdeck more unstable, e.g., by raising the snowdeck's center of gravity. As a result, extending the runner ends beyond the ends of the deck 1 can provide a stable snowdeck in which the runner ends have an improved range of movement. Of course, it should be understood that the runner 3 need not be longer than the deck 1, as this aspect of the invention need not be used with other aspects of the invention.

Another aspect of the invention illustrated in FIG. 3 is that the ends of the deck 1 are upturned away from the ends of the runner 3. This feature may be used in combination with extending the runner ends past the ends of the deck 1, or in an arrangement in which one or both of the runner ends do not extend past a corresponding end of the deck 1. That is, the upturned ends on the deck 1 also serve to increase the distance between the upturned portions of the runner 3 and the deck 1, thus increasing the flex range of the runner ends. Upturned ends on the deck 1 may also have other benefits, such as allowing a rider to feel the ends of the deck 1 and keep the rider's feet on the deck 1, as well as allowing the rider to lever the snowdeck around a lateral axis. For example, the rider may be able to place a foot on a rear upturned portion and, by placing weight on the rear foot, raise the front end of the snowdeck.

Figure 4:
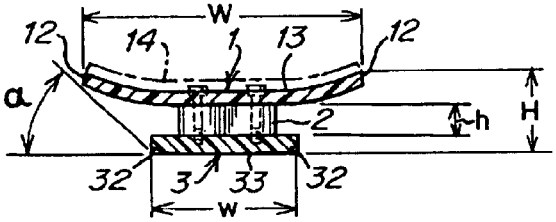
FIG. 4 is a cross-sectional view of the embodiment along the line 4—4 in FIG. 3.

A cross-sectional view of the snowdeck along the line 4—4 is shown in FIG. 4. One aspect of the invention illustrated in FIG. 4 is the deck 1 has uplifted lateral edges 12. That is, in this illustrative embodiment, the deck 1 has a concave upper surface on which the rider stands. These upturned edges 12 may make the snowdeck more responsive when the rider initiates a turn because the rider may be able to more quickly transfer weight from a heel or toe to one of the upturned lateral edges 12. In addition, the concave upper surface may help keep a rider's feet in place on the deck 1. Although in this embodiment the lateral edges 12 are uplifted along the mid-section of the deck 1 and terminate near where the ends of the deck 1 begin to turn upward, the lateral edges 12 may be uplifted along the entire length L of the deck 1, or only along selected portions. Also, although in this embodiment the lateral edges 12 gradually curve upward, the uplifted edges 12 may be formed by one or more steps or an angled slope.

Another aspect of the invention shown in this illustrative embodiment is that the deck 1 has a convex lower surface that causes the edges 12 of the deck 1 to be positioned vertically further away at a height H from the lower surface 33 of the runner 3 than a central portion of the upper surface 13 of the deck 1 that is attached to the spacers 2. As a result, a rider may be able to execute more aggressive turns because of the snowdeck's ability to tilt at a steep angle without touching one of the lateral edges 12 to the sliding surface. For example, when executing a turn, a rider will tilt the snowdeck to pivot around one of the edges 32 on the runner 3. Since the bottom surface of the deck 1 curves upwardly away from the runner 3, the snowdeck may tilt, i.e., pivot about one of the edges 32, at a more steep angle than would be possible if the bottom of the deck 1 was not curved or uplifted near the edges 12. Although in this embodiment the bottom surface of the deck 1 has a smoothly curving surface, the edges 12 may be uplifted from the runner 3 in other ways. For example, the bottom surface of the deck 1 may be stepped or have angular portions to form the convex surface.

Although in this illustrative embodiment the deck 1 has a concave upper surface and a convex lower surface, both of these aspects of the invention need not be combined in the deck 1. For example, the deck 1 may have a flat upper surface and a convex lower surface, or a convex upper surface and a flat lower surface.

Another aspect of the invention shown in FIG. 4 is that the deck 1 is arranged to allow greater tilting before the edges 12 of the deck 1 contact the sliding surface. That is, an angle $\alpha$ formed between the plane of the lower surface 33 of the runner 3 and a line extending between an edge 32 of the runner 3 and an edge 12 of the deck 1 may be approximately 30 and 70 degrees. This angle $\alpha$ may be adjusted based on the vertical separation of the upper surface 13 of the deck 1 and the lower surface 33 of the runner 3, the relative widths w and W of the runner 3 and the deck 1, the uplift of the lateral edges 12, and/or other features. In this illustrative embodiment, the vertical separation between the upper surface 13 of the deck 1 and the lower surface 33 of the runner 3 may be controlled by the height h of the spacers 2. The height h of the spacers 2 may be approximately 0.375 to 8 inches, where the runner 3 has a thickness of approximately 0.25 inches and the deck 1 has a thickness of approximately 0.375 inches at the attachment point with the spacers 2. Thus, the minimum vertical spacing between the lower surface 33 of the runner 3 and the upper surface 13 of the deck 1 near attachment points to the spacers 2 can be approximately 1 inch to 8.375 inches, and more preferably approximately 1.75 and 4 inches. The inventors have found that vertical spacings outside of the 1 to 8.375 inch range, and in some cases outside of the 1.75 to 4 inch range (e.g., depending on the width ratio of the deck 1 and runner 3 discussed below), either result in a snowdeck that does not have proper maneuvering capabilities or one that is too unstable, i.e., prone to uncontrollable tilting.

Another aspect of the invention illustrated in FIG. 4 is that the width w of the runner 3 is less than the width W of the deck 1. Although the widths w and W of the runner 3 and the deck 1 may vary along the length of the snowdeck, in general, the ratio of w:W is approximately 0.4 to 0.8, and more preferably approximately 0.45 to 0.6. It has been found that these ratios between the widths w and W provides good leverage for the rider to maneuver the snowdeck, while also providing a stable ride, e.g., the snowdeck is not prone to uncontrolled tilting. The width w of the runner 3 may be approximately 3.5 to 12 inches, and the width W of the deck 1 may be approximately 7 to 15 inches. In general, the ratio of the widths w and W may be increased as the height h of the spacers 2 (or other measure of the vertical separation of the upper surface 13 of the deck 1 and the lower surface 33 of the runner 3) increases. That is, if the deck 1 and runner 3 are separated by a relatively large distance, the ratio of the widths w:W may be increased to provide stability to the snowdeck, and vice versa. For example, if the separation of the upper surface 13 and the lower surface 33 is within the lower end of the 1 to 8.375 inch range, e.g., 1 to 4 inches, the ratio of w:W is preferably within the lower end of the 0.4 to 0.8 range, e.g., 0.4 to 0.6. On the other hand, if the separation of the upper surface 13 of the deck 1 and the lower surface 33 of the runner 3 is at the upper end of the 1 to 8.375 range, e.g., 4 to 8.375 inches, the ratio of w:W is preferably within the upper end of the 0.4 to 0.8 range, e.g., 0.6 to 0.8. It should be understood, however, that this aspect of the invention need not be combined with embodiments that incorporate other aspects of the invention.

As may be appreciated by the discussions above, the relative sizes of the different portions of the snowdeck may be important to the performance of the snowdeck. For example, in one aspect of the invention, it has been found that an overall length l of the runner 3 of approximately 32.5 inches, a length L of the deck 1 of approximately 32 inches, a distance d of approximately 8 inches, a height h of the spacers 2 of approximately 0.5 inches (given approximately the same thicknesses for the deck 1 and runner 3 mentioned above), a height H from a bottom of the runner 3 to the lateral edges 12 of approximately 1.5 inches, a width w of the runner 3 of approximately 4.5 inches and a width W of the deck 1 of approximately 8.5 inches provide a snowdeck having excellent handling and trick performance. Of course, the sizes of the different portions of the snowdeck may be varied from this illustrative embodiment, but in some embodiments it will be desirable to maintain approximately the same ratios between at least some of the sizes as that in this illustrative embodiment. For example, in some embodiments, the ratio of the widths w and W and the ratio of the width w to the height h may be important to maintain.

Figure 5:
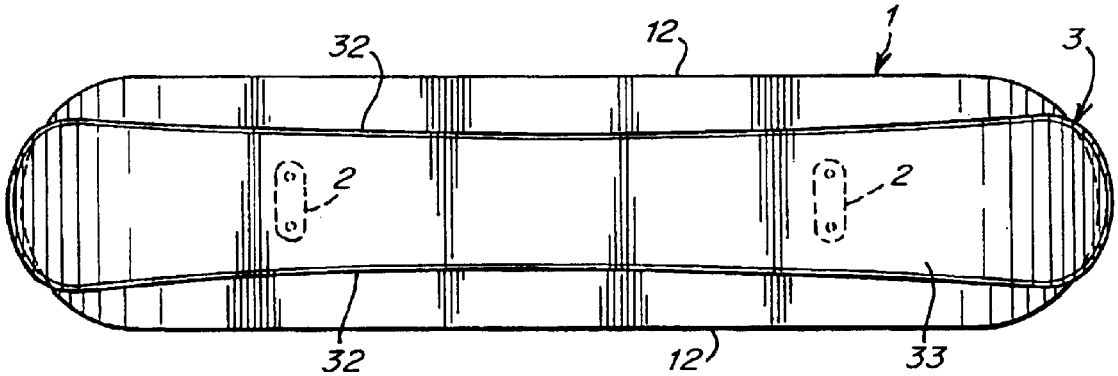
FIG. 5 is a bottom view of the FIG. 1 embodiment.

FIG. 5 shows a bottom view of the snowdeck. In this view of the illustrative embodiment, it can be seen that the runner 3 has some amount of sidecut, i.e., the edges 32 of the runner 3 are concave. This aspect of the invention provides for more responsive turning in the snowdeck because as a rider tilts the snowdeck up onto one of the edges 32, the sidecut of the edge 32 causes the snowdeck to more easily track in a curved direction. A balance may also be made between the amount of sidecut of the runner 3 and the flexibility of the runner 3 at its central region between the spacers 2 and/or at the runner ends. Although a sidecut runner 3 may be used in a preferred embodiment, the runner 3 may be made to have little or no sidecut.

The deck 1 is also shown in FIG. 5 as having a roughly elliptical shape with approximately straight lateral edges 12. It should be understood, however, that the deck 1 may have some degree of sidecut, e.g., the deck 1 may be more narrow near the middle than at the ends, so that a rider is provided with less leverage to tilt the snowdeck near the middle as compared to at the ends of the deck 1. Other shapes for the deck 1 will occur to those of skill in the art.

Figure 6:
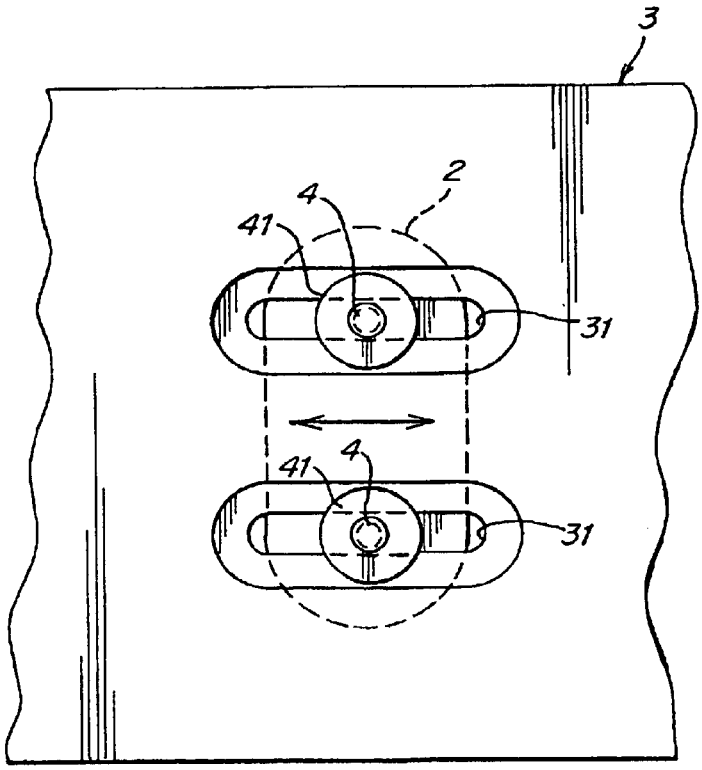
FIG. 6 is a bottom view of an attachment arrangement between a runner and a spacer in an illustrative embodiment.

FIG. 6 shows a bottom view of an alternate attachment arrangement between a runner 3 and a spacer 2. In this illustrative embodiment, the runner 3 has holes 31 that are formed as longitudinally extending slots. Thus, bolts 4 that extend through the holes 31 and engage with nuts 41 allow the runner 3 to slide longitudinally along the direction shown by the double headed arrow in FIG. 6 relative to the deck 1 (not shown) during riding. Such an attachment arrangement may prevent any pivoting of the deck 1 about a longitudinal axis relative to the runner 3, but allow the runner 3 to slide longitudinally relative to the deck 1. Sliding of the runner 3 may allow a central portion of the runner 3 between spacers 2 at opposite ends of the runner 3 to have greater flexibility and improve the performance of the snowdeck during riding. Although the attachment arrangement of FIG. 6 may be used at all spacer 2 locations, the attachment arrangement may be used at a spacer location at one end of the runner 3, while an attachment arrangement in which sliding of the runner 3 is prevented is used at the other end of the runner 3. It should be understood that the slots may extend laterally rather than longitudinally. Moreover, regardless of the direction in which they extend, the slots may allow for adjustment of the position of the spacers 2 on the snowdeck. For example, the deck 1 and runner 3 may have longitudinally extending slots for the holes 11 and 31 so that a rider can adjust the spacer 2 location, e.g., by loosening the bolts 4, moving the spacers 2 to a desired location and again tightening the bolts 4 to tune the snowdeck response for specific riding conditions or performance characteristics. Thus, the slots may not necessarily allow the runner 3 to slide longitudinally relative to the deck 1 during riding, but rather allow the spacer position to be adjusted and then locked in position for riding.

As mentioned above, the various portions of the snowdeck may be made using any suitable techniques, materials or processes. For example, the deck 1 may be made of wood, metal, plastic, a laminate or a composite material, such as plywood, or other, and may be constructed in much the same way as a typical skateboard deck.

The runner 3 may be made in a way similar to typical skis or snowboards and have metal edges 32, a plastic base material, vertical or horizontal wood laminate core or foam core material, and so on. An exemplary runner 3 would include a vertical laminate wood core surrounded by one or more layers of fiber laminate for torsional control. A sintered, extruded or graphite base is provided on the snow contacting surface of the runner 3 while a plastic, preferably opaque, top sheet for protecting the core and laminate from abrasion and from exposure to ultraviolet light is arranged on the opposite surface. Sidewall, cap or mixed sidewall/cap construction may be employed to protect the core. Stainless steel edges may be included to enhance edge grip. The runner 3 may be arranged with a fully distinct nose and tail for directional riding or, instead, with identical shaped tips (and flex patterns) at both ends for matched riding with either the tip or tail forward. The runner 3 may have a sidecut for ease of turning the sliding device. Preferably, the nose and tail will be upturned in a shovel arrangement.

In addition, the snowdeck may be made as a single molded article, e.g., the deck 1, spacers 2 and runner 3 may be made together as a single integral unit. Alternately, portions of the snowdeck may be made as a single integral unit, e.g., the deck 1 and the spacers 2 may be formed as an integral unit that is attached to a runner 3.

While the invention has been described in conjunction with specific embodiments thereof, many alternatives, modifications, and variations will be apparent to those skilled in the art. Accordingly, embodiments as set forth herein are intended to be illustrative of the various aspects of the invention, not limiting. Various changes may be made without departing from the spirit and scope of the invention.

What is claimed is:

1. A sliding device for supporting a rider when sliding on a surface, comprising:

a runner having first and second upturned ends and an intermediate portion between the upturned ends, the runner having an overall length of at most 45 inches;

a deck elevated from the runner, the deck having a front to back direction and an upper surface for supporting-a rider; and a spacer secured to the runner at a runner attachment position and secured to the deck at a deck attachment position so that forces applied by a rider on the deck are transmitted to the runner, and so that the deck is restrained from pivoting relative to the runner about an axis running in the front to back direction;

wherein the runner and the deck are constructed and arranged to allow riding with both the first upturned end of the runner forward and the second upturned end of the runner forward, and wherein the runner has a width that is approximately 0.4 to 0.8 times a width of the deck, and the deck has a width between 7 and 15 inches.

2. The device of claim 1, wherein the spacer is constructed and arranged to allow one of relative rotation of the deck and runner in the front to back direction and relative longitudinal movement of the deck and runner.

3. The device of claim 2, wherein the upper surface of the deck includes a portion that is concave in an edge-to-edge direction.

4. The device of claim 2, wherein the deck includes upturned longitudinal ends.

5. The device of claim 2, wherein the spacer is constructed and arranged to allow relative rotation of the deck and runner in the front to back direction.

6. The device of claim 2, wherein the ratio of the overall deck length to the overall runner length is at least 0.75.

7. The device of claim 2, wherein the deck has no foot bindings to secure a rider's feet to the deck.

8. The device of claim 2, wherein the runner has an overall length of at most 40 inches.

9. The device of claim 2, comprising first and second spacers, wherein the runner has an overall length and the first spacer is positioned longitudinally inward from the first upturned end of the runner at a distance equal to approximately one-fifth to one-third of the overall length, and the second spacer is positioned longitudinally inward from the second upturned end of the runner at a distance equal to approximately one-fifth to one-third of the overall length.

10. The device of claim 2, wherein the overall runner length and the overall deck length differ by at most 10 inches.

11. The device of claim 2, wherein the overall runner length and the overall deck length differ by at most 5 inches.

12. The device of claim 2, wherein the runner has an overall length of at most 35 inches.

13. The device of claim 2, wherein at least one of the first and second upturned ends of the runner extends beyond a corresponding end of the deck.

14. The device of claim 2, wherein the runner is longer than the deck and the first and second upturned ends of the runner extend beyond corresponding ends of the deck.

15. The device of claim 14, wherein the first and second upturned ends are free to move relative to the deck.

16. The device of claim 2, wherein one of the first and second upturned runner ends contacts the deck.

17. The device of claim 2, wherein a minimum spacing between the upper surface of the deck and a lower surface of the runner is approximately 1 to 8.375 inches.

18. The device of claim 2, wherein the runner has a sidecut.

19. The device of claim 2, comprising two spacers that are longitudinally displaced and have a same height, wherein the runner and the deck are secured together by the two longitudinally displaced spacers.

20. The device of claim 2, wherein the runner is equally spaced vertically from the deck along the intermediate portion of the runner.

21. The device of claim 2, wherein the spacer is constructed and arranged to allow relative longitudinal movement of the deck and runner.

22. The device of claim 2, wherein the deck is longer than the runner.

23. The device of claim 2, wherein the deck is constructed and arranged to support both feet of a rider.

24. The device of claim 1, wherein the spacer is constructed and arranged to allow movement of the deck and runner toward each other to decrease a distance between a lower surface of the runner near the runner attachment position and the upper surface of the deck near the deck attachment position.

25. A sliding device for supporting a rider when sliding on a surface, comprising:

a runner having first and second upturned ends and a middle portion;

a deck elevated from the runner, the deck having an upper surface for supporting a rider; and a spacer secured to the runner at a runner attachment position and secured to the deck at a deck attachment position so that forces applied by a rider on the deck are transmitted to the runner;

wherein one or both of the runner and the deck is arranged and mounted to the spacer to allow movement of a portion of either the runner or the deck relative to the other, wherein the runner and deck are constructed and arranged to provide equivalent riding performance with the first runner end forward and the second runner end forward, and wherein the runner has a width that is approximately 0.4 to 0.8 times a width of the deck, and the deck has a width between 7 and 15 inches.

26. The device of claim 25, wherein the deck includes uplifted lateral edges that are positioned vertically farther away from the runner than a central portion of the deck.

27. The device of claim 25, wherein an angle formed between a plane of a bottom surface of the runner and a line extending between a lower edge of the runner and a lateral edge of the deck is between 30 and 70 degrees.

28. The device of claim 25, wherein the upper surface of the deck is arranged for a gripping surface.

29. The device of claim 25, further comprising a foam material secured to at least one portion of the upper surface of the deck.

30. The device of claim 25, comprising first and second spacers, wherein the first spacer is positioned nearer the first upturned end of the runner and a second spacer is positioned nearer the second upturned end of the runner, wherein the runner has an overall length and the first and second spacers are separated longitudinally by a distance equal to approximately zero to three-fifths the overall length of the runner.

31. The device of claim 25, comprising two spacers, wherein the two spacers are longitudinally separated from each other and attach the runner and the deck together, and a portion of the runner between the spacers is free to flex relative to the deck.

32. The device of claim 25, wherein at least one of the first and second upturned ends of the runner is free to move relative to the deck.

33. The device of claim 25, wherein at least one of the deck and the runner are directly secured to the spacer.

34. The device of claim 25, wherein the runner and deck are constructed and arranged to allow adjustment of the position of the spacer relative to the runner or the deck.

35. The device of claim 25, wherein at least one of the first and second upturned ends is constructed and arranged to contact the deck while the device is being ridden.

36. A sliding device for supporting a rider when sliding on a surface, comprising:

a runner having first and second upturned ends, an intermediate portion between the upturned ends, and an overall length;

a deck elevated from the runner, the deck having a front to back direction, an upper surface for supporting a rider, and an overall length; and a spacer secured to the runner at a runner attachment position and secured to the deck at a deck attachment position so that forces applied by a rider on the deck are transmitted to the runner, and so that the deck is restrained from pivoting relative to the runner about an axis running in the front to back direction;

wherein the runner and the deck are constructed and arranged to allow riding with both the first upturned end of the runner forward and the second upturned end of the runner forward, wherein the overall runner length and the overall deck length differ by at most 13 inches, and wherein the runner has a width that is approximately 0.4 to 0.8 times a width of the deck, and the deck has a width between 7 and 15 inches.

37. The device of claim 36, wherein the spacer is constructed and arranged to allow one of relative rotation of the deck and runner in the front to back direction and relative longitudinal movement of the deck and runner.

38. The device of claim 37, wherein the runner and deck are constructed and arranged to provide equivalent riding performance with the first runner end forward and the second runner end forward.

39. The device of claim 37, wherein a minimum spacing between the upper surface of the deck and a lower surface of the runner is approximately 1 to 8.375 inches.

40. The device of claim 37, wherein the runner has a sidecut.

41. The device of claim 37, wherein a portion of the deck is wider than a widest portion of the runner.

42. The device of claim 37, wherein the runner is equally spaced vertically from the deck along the intermediate portion of the runner.

43. The device of claim 37, wherein one of the runner and the deck has a length of between approximately 25 and 45 inches.

44. The device of claim 37, wherein the upper surface of the deck includes a portion that is concave in an edge-to-edge direction.

45. The device of claim 37, wherein at least one of the deck and the runner are directly secured to the spacer.

46. The device of claim 37, wherein the deck includes upturned longitudinal ends.

47. The device of claim 37, wherein the deck includes uplifted lateral edges that are positioned vertically farther away from the runner than a central portion of the deck.

48. The device of claim 37, wherein an angle formed between a plane of a bottom surface of the runner and a line extending between a lower edge of the runner and a lateral edge of the deck is between 30 and 70 degrees.

49. The device of claim 37, wherein the upper surface of the deck is arranged for a gripping surface.

50. The device of claim 37, further comprising a foam material secured to at least one portion of the upper surface of the deck.

51. The device of claim 37, comprising first and second spacers, wherein the runner has an overall length and the first spacer is positioned longitudinally inward from the first upturned end of the runner at a distance equal to approximately one-fifth to one-third of the overall length of the runner, and the second spacer is positioned longitudinally inward from the second upturned end of the runner at a distance equal to approximately one-fifth to one-third of the overall length of the runner.

52. The device of claim 37, comprising first and second spacers, wherein the first spacer is positioned nearer the first upturned end of the runner and a second spacer is positioned nearer a second upturned end of the runner, wherein the runner has an overall length and the first and second spacers are separated longitudinally by a distance equal to approximately zero to three-fifths the overall length of the runner.

53. The device of claim 52, wherein a portion of the runner between the spacers is free to flex relative to the deck.

54. The device of claim 37, wherein the first and second upturned ends of the runner are free to move relative to the deck.

55. The device of claim 37, wherein at least one of the first and second upturned ends of the runner extends beyond a corresponding end of the deck.

56. The device of claim 37, wherein the runner is longer than the deck and the first and second upturned ends of the runner extend beyond corresponding ends of the deck.

57. The device of claim 37, wherein the first and second upturned ends are free to move relative to the deck.

58. The device of claim 37, wherein the runner has an overall length of at most 40 inches.

59. The device of claim 37, wherein the runner has an overall length of at most 35 inches.

60. The device of claim 37, wherein the overall runner length and the overall deck length differ by at most 10 inches.

61. The device of claim 37, wherein the overall runner length and the overall deck length differ by at most 5 inches.

62. The device of claim 37, wherein the ratio of the overall deck length to the overall runner length is at least 0.75.

63. The device of claim 37, wherein one of the first and second upturned runner ends contacts the deck.

64. The device of claim 36, wherein the spacer is constructed and arranged to allow movement of the deck and runner toward each other to decrease a distance between a lower surface of the runner near a runner attachment position and the upper surface of the deck near a deck attachment position.

65. The device of claim 37, wherein the spacer is constructed and arranged to allow relative rotation of the deck and runner in the front to back direction.

66. The device of claim 37, wherein the spacer is constructed and arranged to allow relative longitudinal movement of the deck and runner.

67. The device of claim 37, wherein the deck is longer than the runner.

68. The device of claim 37, wherein the deck is constructed and arranged to support both feet of a rider.

69. The device of claim 37, wherein the deck has no foot bindings to secure a rider's feet to the deck.

70. A sliding device for supporting a rider when sliding on a surface, comprising:

a runner having first and second upturned ends, an intermediate portion between the upturned ends, and an overall length;

a deck elevated from the runner, the deck having a front to back direction, an upper surface for supporting a rider, and an overall length; and a spacer secured to the runner at a runner attachment position and secured to the deck at a deck attachment position so that forces applied by a rider on the deck are transmitted to the runner, and so that the deck is restrained from pivoting relative to the runner about an axis running in the front to back direction;

wherein the runner and the deck are constructed and arranged to allow riding with both the first upturned end of the runner forward and the second upturned end of the runner forward, wherein the ratio of the overall deck length to the overall runner length is at least 0.75, and wherein the runner has a width that is approximately 0.4 to 0.8 times a width of the deck, and the deck has a width between 7 and 15 inches.

71. The device of claim 70, wherein the spacer is constructed and arranged to allow movement of the deck and runner toward each other to decrease a distance between a lower surface of the runner near the runner attachment position and the upper surface of the deck near the deck attachment position.

72. The device of claim 70, wherein the spacer is constructed and arranged to allow one of relative rotation of the deck and runner in the front to back direction and relative longitudinal movement of the deck and runner.

73. The device of claim 72, wherein the runner has an overall length of at most 40 inches.

74. The device of claim 72, wherein the runner has an overall length of at most 35 inches.

75. The device of claim 72, wherein the overall runner length and the overall deck length differ by at most 10 inches.

76. The device of claim 72, wherein the overall runner length and the overall deck length differ by at most 5 inches.

77. The device of claim 72, wherein one of the first and second upturned runner ends contacts the deck.

78. The device of claim 72, wherein the deck has no foot bindings to secure a rider's feet to the deck.

79. The device of claim 72, wherein the runner and deck are constructed and arranged to provide equivalent riding performance with the first runner end forward and the second runner end forward.

80. The device of claim 72, wherein the upper surface of the deck includes a portion that is concave in an edge-to-edge direction.

81. The device of claim 72, further comprising a foam material secured to at least one portion of the upper surface of the deck.

82. The device of claim 72, comprising first and second spacers, wherein the first spacer is positioned longitudinally inward from the first upturned end of the runner at a distance equal to approximately one-fifth to one-third of the overall length of the runner, and the second spacer is positioned longitudinally inward from the second upturned end of the runner at a distance equal to approximately one-fifth to one-third of the overall length of the runner.

83. The device of claim 72, comprising first and second spacers, wherein the first spacer is positioned nearer the first upturned end of the runner and a second spacer is positioned nearer a second upturned end of the runner, wherein the runner has an overall length and the first and second spacers are separated longitudinally by a distance equal to approximately zero to three-fifths the overall length of the runner.

84. The device of claim 72, comprising two spacers, wherein the two spacers are longitudinally separated from each other and attach the runner and the deck together, and a portion of the runner between the spacers is free to flex relative to the deck.

85. The device of claim 72, wherein the first and second upturned ends of the runner are free to move relative to the deck.

86. The device of claim 72, wherein the deck is constructed and arranged to support both feet of a rider.

87. The device of claim 72, wherein a minimum spacing between the upper surface of the deck and a lower surface of the runner is approximately 1 to 8.375 inches.

88. The device of claim 72, wherein the runner has a sidecut.

89. The device of claim 72, comprising two spacers that are longitudinally displaced and have a same height, wherein the runner and the deck are secured together by the two longitudinally displaced spacers.

90. The device of claim 72, wherein the spacer is constructed and arranged to allow relative rotation of the deck and runner in the front to back direction.

91. The device of claim 72, wherein the spacer is constructed and arranged to allow relative longitudinal movement of the deck and runner.

92. The device of claim 72, wherein the deck is longer than the runner.

93. A sliding device for supporting a rider when sliding on a surface, comprising:

a runner having first and second upturned ends and a middle portion;

a deck elevated from the runner, the deck having an upper surface for supporting a rider; and a spacer secured to the runner at a runner attachment position and secured to the deck at a deck attachment position so that forces applied by a rider on the deck are transmitted to the runner;

wherein one or both of the runner and the deck is arranged and mounted to the spacer to allow longitudinal movement of either the runner or the deck relative to the other, wherein the runner and deck are constructed and arranged to provide equivalent riding performance with the first runner end forward and the second runner end forward, and wherein the runner has a width that is approximately 0.4 to 0.8 times a width of the deck, and the deck has a width between 7 and 15 inches.

94. A sliding device for supporting a rider when sliding on a surface, comprising:

a runner having first and second upturned ends and a middle portion;

a deck elevated from the runner, the deck having an upper surface for supporting a rider and including uplifted lateral edges that are positioned vertically farther away from the runner than a central portion of the deck; and a spacer secured to the runner at a runner attachment position and secured to the deck at a deck attachment position so that forces applied by a rider on the deck are transmitted to the runner;

wherein one or both of the runner and the deck is arranged and mounted to the spacer to allow movement of a portion of either the runner or the deck relative to the other, and wherein the runner and deck are constructed and arranged to provide equivalent riding performance with the first runner end forward and the second runner end forward.

95. A sliding device for supporting a rider when sliding on a surface, comprising:

a runner having first and second upturned ends and a middle portion;

a deck elevated from the runner, the deck having an upper surface for supporting a rider; and a spacer secured to the runner at a runner attachment position and secured to the deck at a deck attachment position so that forces applied by a rider on the deck are transmitted to the runner;

wherein one or both of the runner and the deck is arranged and mounted to the spacer to allow movement of a portion of either the runner or the deck relative to the other, wherein the runner and deck are constructed and arranged to provide equivalent riding performance with the first runner end forward and the second runner end forward, and wherein an angle formed between a plane of a bottom surface of the runner and a line extending between a lower edge of the runner and a lateral edge of the deck is between 30 and 70 degrees.

* * * * *